United States Patent [19]

de Jonge

[11] 4,168,918

[45] Sep. 25, 1979

[54] DEVICE FOR CLEANING STIRRER TANKS

[75] Inventor: Heinrich de Jonge, Zug, Switzerland

[73] Assignee: Dejonge AG, Zug, Switzerland

[21] Appl. No.: 911,506

[22] Filed: Jun. 1, 1978

[30] Foreign Application Priority Data

Jun. 14, 1977 [DE] Fed. Rep. of Germany ..... 2726800

[51] Int. Cl.[2] ..... B01F 7/16

[52] U.S. Cl. ..... 366/169

[58] Field of Search ..... 366/167–172

[56] References Cited

U.S. PATENT DOCUMENTS

| | | | |
|---|---|---|---|
| 2,347,195 | 4/1944 | Huff | 366/169 |
| 2,592,709 | 4/1952 | Kinnaird | 366/169 |

*Primary Examiner*—Leonard D. Christian

*Attorney, Agent, or Firm*—Blanchard, Flynn, Thiel, Boutell & Tanis

[57] ABSTRACT

A device for cleaning stirrer tanks, including a stirring apparatus mounted in the tank and a drive motor with a hollow drive shaft nonrotatably connected to a hollow shaft which extends therethrough into the tank and supports a stirring tool. The hollow shaft passes through a seal in the tank wall and can be connected to an inlet port to supply the stirrer tank with a cleaning medium, e.g. a fluid containing a wetting agent, which cleaning medium is capable of being distributed in the tank interior by spray means formed as spray nozzles. The upper and lower sides of said stirring tool and the area on the inside of the seal are acted upon by the cleaning medium which is supplied under pressure by the spray means. The hollow shaft is mounted so as to be easily removable from the drive shaft in order to clean the spray means.

5 Claims, 2 Drawing Figures

DEVICE FOR CLEANING STIRRER TANKS

FIELD OF THE INVENTION

This invention relates to a device for cleaning a stirrer tank comprising a strirring apparatus mounted therein and a drive motor with a hollow drive shaft for a hollow shaft which supports the stirring tool, which shaft penetrates a seal in the tank wall and which can be connected to an inlet port to supply said stirrer tank with a cleaning medium, e.g. a fluid containing a wetting agent, said cleaning medium being capable of being distributed in the tank interior by a spray means consisting of spray nozzles.

BACKGROUND OF THE INVENTION

A device for cleaning stirrer tanks is known, for example, from German patent specification No. 2,307,609. In this case the stirrer tank is an upright tank upon which a stirring apparatus is positioned which is connected with a drive motor. In order to mount the stirring apparatus, the upright tank is provided on its upper side with a connection piece which engages in a base structure which is secured to said upper side and which includes a horizontally extending flange. An electrically driveable flange motor with a hollow drive shaft is screwed to the flange of this base structure. A hollow shaft supporting at its lower end the stirring tool, e.g. an impeller, a propeller or the like, is guided through the hollow drive shaft, penetrates a seal mounted on the tank in the connection piece or even therebelow and is nonrotatably connecting with the hollow drive shaft via an abutment, a flange coupling or the like. The hollow shaft supporting the stirring tool has on its lower end wall a spray nozzle whose jets are directed onto the bottom of the tank. Moreover, spray nozzles whose jets act on the inner jacket surface of the stirrer tank are also located in a specific spaced relation on the hollow shaft inside the stirrer tank.

Such a cleaning device is capable of adequately cleaning the inner surface of the stirrer tank, but it is a fact in the dairy industry, for instance, that most of the deposits or residues form on the stirring apparatus and in the area of the seal which guides the hollow shaft through the upper tank wall. These deposits are fairly difficult to remove, particularly since they are not included as part of the normal tank cleaning operation.

In addition, the nozzles themselves require cleaning and replacement at times which, however, is only feasible in most cases when the stirring apparatus has been removed from the tank or when the hollow shaft for the cleaning medium supply has previously been driven out of the hollow drive shaft, it then being possible to remove the drive motor and to maneuver the hollow shaft out of the manhole in the stirrer tank. It has been found, however, that in these known blending or stirring devices, the hollow shaft has frequently seized or is so corroded in the hollow drive shaft that it can no longer be removed from the hollow drive shaft. In such a case, there is usually no other recourse than to cut off the hollow shaft for the stirring tool drive, to provide a new drive motor and to weld a new stirring shaft stump on to the hollow shaft. Such repair work is therefore not only costly, but also results in long interruptions of operation (down-time) so that hitherto known mixing and stirring devices have not been satisfactory.

The object of the invention is therefore to further develop the known device for cleaning stirrer tanks using further features of the class mentioned in the first paragraph at the outset in such a way that deposits on the stirring tool, in the sealing area of the hollow shaft and on the nozzles can be eliminated with simple and economically feasible measures.

This object is accomplished in principle in that the upper and lower sides of said stirring tool and the area on the inside of the seal which guides the hollow shaft through the tank wall or upper end wall are acted upon by the spray means by the cleaning medium which is supplied under pressure, and that the hollow shaft is mounted so as to be easily removable from the drive shaft in order to clean the spray means.

These measures ensure a cleaning oven even of those parts of the stirrer tank which are affected by deposits especially during operation and which were hitherto inaccessible without special and costly measures. Of course, the customary arrangement of spray nozzles can be retained which simultaneously act on the sidewall, the bottom and the top wall of the stirrer tank.

In particular, the design is such that the end of the hollow shaft which faces the tank bottom is releasably closed by a spray nozzle or a nozzle head which directs the cleaning medium onto the lower side of the stirrer tool. Such a spray nozzle or such a spray head has correspondingly directed nozzle apertures so that the entire bottom side of the stirring tool is certain to be cleaned by the cleaning medium.

The same action can be achieved for the entire stirrer tool in that the end of the hollow shaft facing the tank bottom is closed to the cleaning medium and bores, and nozzles or the like are disposed in the hub of the stirring tool formed by an impeller, propeller or the like in such a way that the jets of cleaning medium act on the upper and lower sides of the impeller, propeller or the like.

Furthermore, it is provided that a least two diametrically opposed, downwardly directed spray nozzles or spray heads which penetrate the wall or the cylinder jacket of said hollow shaft are provided to act on the upper side of the stirrer tool only. Such an arrangement is adequate when an impeller, for example, which serves as the stirrer tool has only two vanes. If more vanes exist, a corresponding additional number of spray nozzles are provided in the hollow shaft.

Another arrangement is characterized in that a ring of spray nozzles or spray heads directed onto the area on the inside of the seal is disposed below the seal which guides the hollow shaft through the tank wall. The arrangement of the nozzles can also be arbitrary. What is important is that the area facing the stirrer tool of the seal guiding the hollow shaft through the container wall is included and acted upon intensely by the cleaning medium.

In a device for cleaning stirrer tanks comprising a hollow shaft for supplying the cleaning medium which penetrates the hollow drive shaft of the drive motor and which is upwardly supported therein, the embodiment is designed such that the hollow shaft is nonrotatably mounted in the end of the hollow drive shaft facing away from the stirrer tank by means of a flange sleeve which is designed to have an external conical taper toward its free end and is adapted to be pressed into the corresponding conical hollow end of the drive shaft on the flange side by means of a threaded nut adapted to be screwed onto the hollow shaft and to nonrotatably interconnect the hollow shaft with the hollow drive shaft in cooperation with the abutment upwardly supporting said hollow shaft. Serving as the abutment, the lower end of the hollow drive shaft on the inside and the proximate portion of the hollow shaft for the cleaning medium have a conical design such that, after the flange sleeve has been loosened at the upper end of the drive shaft, the hollow shaft can be easily withdrawn or driven out of the drive motor.

Since the flange sleeve can be loosened without difficulty in case of necessity, for example for cleaning the spray nozzles, the mounting designed in accordance with the invention thus facilitates not only convenient assembly, but in particular rapid disassembly of the hollow shaft as well and thus shorter interruptions of operation. These advantages are attained at a very low cost so that the complete and comprehensive cleaning of a stirrer tank is now extraordinarily economical to carry out. In addition, due to the conical abutment and the externally conical flange sleeve, the hollow shaft is centered exactly relative to the hollow drive shaft when the threaded nut which can be screwed on the hollow shaft is tightened so that smooth running of the hollow shaft is ensured.

It is self-evident that it is unimportant in the inventively designed mounting of the hollow shaft in the hollow drive shaft whether an auxiliary medium for the material to be stirred in the stirrer tank, for example, is introduced through the hollow shaft instead of a cleaning medium. Since the above-explained mounting of the hollow shaft has the same importance in all these cases, independent protection will be claimed for the hollow shaft mounting in the hollow drive shaft.

DETAILED DESCRIPTION

Figure 1:
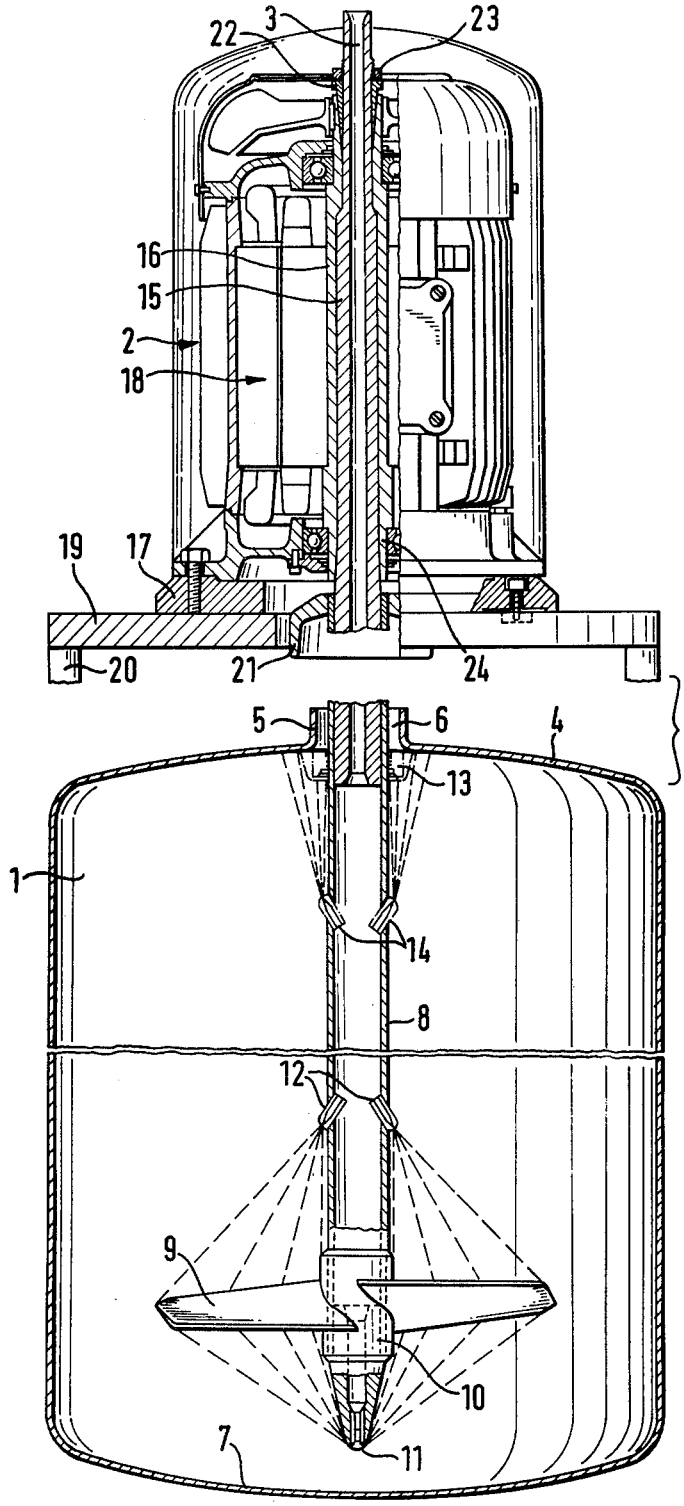
FIG. 1 schematically illustrates a stirrer tank including the associated stirring apparatus and the cleaning device, in part in longitudinal section of this invention.

In the selected embodiment, a stirring or mixing apparatus 2 is located on top of an upright stirrer tank 1 which is designed as an elongated, cylindrical container. Symmetrical to the vertically extending longitudinal axis 3, the stirrer tank 1 has on its upper end wall 4 an opening 6 defined by a connection piece or collar 5 and which serves to permit the passage therethrough of a hollow shaft 8 which extends into the area of the container bottom 7 for supplying a pressurized cleaning medium into said stirrer tank 1. At the lower end of the hollow shaft 8, a bladed impeller 9 is provided as a stirrer tool and is nonrotatably secured to the hollow shaft by means of a hub 10. The impeller 9 has two diametrically opposite vanes or blades which project radially outwardly and are designed and positioned according to fluid dynamic principles. The lower end of the hollow shaft 8 or the hub 10 facing the tank bottom 7 is closed off by a spray nozzle 11 which is designed such that jets of a cleaning medium with a wetting agent emerge from the spray nozzle 11 and impact fully on the underside of the stirrer tool or on the vanes and loosen the deposits. The nozzle 11 thus directs the jets upwardly against the underside of the impeller 9, as indicated by dotted lines.

Two diametrically opposed spray nozzles 12 are provided in the wall or in the cylinder jacket of the hollow shaft 8 above the stirrer tool and are positioned such that the upper side of the vanes of the impeller can also be impacted fully with cleaning medium. A corresponding number of spray nozzles is provided according to the number and size of the vanes.

Figure 2:
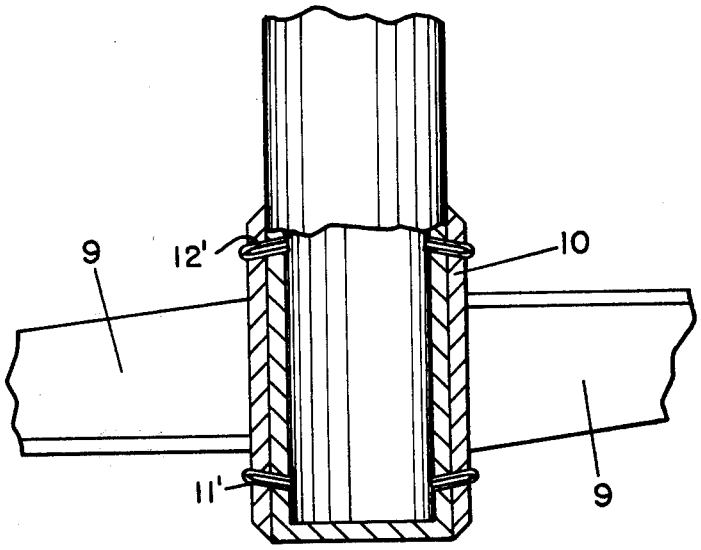
FIG. 2 is a fragmentary, partially sectional view of a modification.

The embodiment, however, can also be carried out by providing a plurality of nozzle apertures 11' and 12' penetrating the cylinder jacket of the hollow shaft and provided in the hub 10 of the stirrer tool (see FIG. 2) in such a manner that the upper and lower sides of the vanes of said impeller 9 are fully impinged with cleaning medium. In this case, however, the end of the hollow shaft 8 or hub 10 which faces the tank bottom 7 is closed so as to seal in the liquid.

Furthermore, the hollow shaft 8 which supports the stirrer tool 9 at its lower end and which passes through the opening 6 into the stirrer tank is guided, below the upper end wall 4, through a seal 13 attached thereto. Deposits often form on the side of said seal which faces the interior of the stirrer tank. For this reason, a ring of spray nozzles 14 is disposed advantageously below and in spaced relation to this seal 13, penetrating the cylinder jacket of the hollow shaft 8 and communicating with the interior of said hollow shaft. These spray nozzles 14 are in turn designed and positioned such that they cause cleaning medium to impinge fully on the area of the inner side of said seal 13.

The portion of the hollow shaft 8 which leads out of the stirrer tank 1 can be sealingly and nonrotatably coupled by a flange or annular coupling or the like (not shown) to a second portion 15 of the hollow shaft which forms an extension thereof so as to prevent the escape of liquid. This second portion 15 is received within and nonrotatably connected to the hollow drive shaft 16 of an electrical drive motor 18, which motor has an attachment flange 17 on the side thereof facing the stirrer tank 1, the attachment flange being designed as an annular flange if desired. The hollow shaft 8 and 15, however, can also be integral in construction.

The electric drive motor 18 can be secured centrally relative to the hollow shaft 8 of the stirrer tank 1 either directly to the upper end wall 4 of the stirrer tank 1 or to a base plate 19 of a separate frame 20 (only schematically indicated in the drawing) which can be anchored to the stirrer tank 1. The base plate 19 can also be provided with an opening centrally located relative to the entire hollow shaft 8, 15 in which a centrifugal ring 21, which has a cup shape in longitudinal section and which is attached to the hollow shaft 8, 15, can rotate in order to eject the water of condensation which forms in the drive motor 18 and prevent it from passing through the opening 6 into the tank.

As mentioned above, the drive shaft 16 of the electrical flange motor 18 which rotates in ball bearings has a hollow construction and is nonrotatably traversed by the hollow shaft 8, 15. For this purpose, the upper end of the drive shaft 16 has a conical construction on the inside such that the mouth thereof has a larger diameter than the proximate cylindrical portion of the clear width. The shaft of a flanged sleeve 22 with a similar conical taper on the external side engages the conical recess of the drive shaft 16. Said flanged sleeve 22 is associated with a screwable threaded nut 23 on a segment of the hollow shaft 15 which is provided with threads and which is stepped in this area. By tightening the threaded nut 23, the flanged sleeve 22 is pressed into the conical recess of the hollow drive shaft 16 and, at the same time, the one- or two-piece hollow shaft 8, 15 is pulled upwardly and pressed against an abutment 24 which is provided at the lower end of the drive shaft 16 and which upwardly supports the hollow shaft, thereby nonrotatably interconnecting the hollow shaft 8, 15 and the hollow drive shaft 16.

The lower end of the hollow drive shaft 16 serves as the abutment 24 and is similarly recessed with a conical taper toward the outside just like the upper end. The hollow shaft 15, which is a bit thicker in this region, has the same conical configuration at this location so that, when the threaded nut 23 is tightened, not only the flanged sleeve 22 is pressed into the hollow drive shaft 16, but the hollow shaft 15 is also pulled into the drive shaft 16 as well. This type of mounting of the hollow shaft 15 in the hollow drive shaft 16 is of special importance for one-piece (integral) hollow shafts 8, 15.

The expense for cleaning the inside of the seal 13 which guides the hollow shaft through the upper tank wall can be reduced considerably and the cleaning action can be intensified even more if, instead of a ring of emitting spray nozzles or spray heads, only a single, correspondingly dimensioned spray nozzle is located in the hollow shaft 8 and the hollow shaft is driven in order to clean this seal area.

To prevent the material being stirred from flowing backwardly through the nozzles into the hollow shaft 8, a one-way element (such as a check valve) can be installed in the nozzles which acts like a nonreturn valve. Only when the cleaning medium attains a corresponding excess pressure does the nonreturn valve open and permit the cleaning medium to flow outwardly through the respective spray nozzle or spray head.

By providing the hollow shaft 8, 15 for supporting and rotating the impeller, which shaft 8, 15 extends concentrically through the drive motor and its drive shaft 16, the open upper end of shaft 8, 15 can be connected to a source of pressurized cleaning medium (not shown) which can be readily supplied through the interior passage of the shaft 8, 15 for cleaning the tank and particularly the seal and impeller.

What is claimed is:

1. A device for cleaning a stirring tank, comprising a drive motor positioned externally of the tank adjacent the upper end thereof, said drive motor having a hollow drive shaft, a hollow stirrer shaft nonrotatably connected to the hollow drive shaft and extending therethrough, said hollow stirrer shaft passing through the tank wall into the interior of the tank, a stirring tool positioned within the tank and secured to said stirrer shaft for rotation therewith, said stirrer tool being formed as an impeller wheel, propeller or the like, an inlet port provided in said hollow shaft for permitting a flowable cleaning medium to be supplied through said hollow stirrer shaft into the tank, and spray means associated with said hollow stirrer shaft within the interior of said tank for distributing the cleaning medium, the improvement wherein the lower end of the hollow stirrer shaft which faces the tank bottom is closed off to prevent escape of the cleaning medium therefrom, the stirring tool having a hub secured to the hollow stirrer shaft, said spray means including spraying nozzles or bores disposed in the hub both above and below the stirring tool and communicating with the interior of the hollow stirrer shaft so that jets of cleaning medium are directed onto the upper and lower sides of the stirring tool to effect cleaning thereof.

2. A device according to claim 1, including an externally tapered conical flanged sleeve coacting between the upper ends of the stirrer and drive shafts for nonrotatably connecting them together, the upper end of the hollow drive shaft having a conical taper on the inside thereof for accommodating the external taper on the flanged sleeve, and a threaded nut threadably secured to the hollow stirrer shaft adjacent the upper end thereof and abutting against the flanged sleeve to securely seat the latter within the tapered upper end of the hollow drive shaft.

3. A device according to claim 2, wherein the hollow drive shaft has an internal conical portion at a location disposed downwardly from the upper end thereof, and wherein the hollow stirrer shaft has an external conical portion for abuttingly seating aganst the internal conical portion of the hollow drive shaft, so that tightening of the threaded nut against the flanged sleeve permits the hollow stirrer shaft to be relatively pulled into the hollow drive shaft.

4. A device according to claim 1, wherein the top wall of the tank has a seal associated therewith through which projects the hollow stirrer shaft, and further spray nozzles associated with said hollow stirrer shaft at a location spaced downwardly from said top wall, said further nozzles being directed outwardly and upwardly relative to the hollow stirrer shaft for directing jets of cleaning medium against the inside of the seal.

5. A device according to claim 4, wherein the stirrer tool includes at least two bladelike elements which project radially outwardly from the hollow stirrer shaft on substantially diametrically opposite sides thereof, and wherein the spray means includes at least two said spray nozzles associated with the upper end of the hub and being directed radially outwardly in diametrically opposite directions and inclined downwardly for cleaning the upper sides of the bladelike elements, and a further pair of said spray nozzles associated with the lower end of the hub and being disposed on diametrically opposite sides thereof and being directed radially outwardly and upwardly to clean the lower sides of said bladelike elements.

* * * * *

UNITED STATES PATENT AND TRADEMARK OFFICE

CERTIFICATE OF CORRECTION

PATENT NO. : 4 168 918

DATED : September 25, 1979

INVENTOR(S) : Heinrich de Jonge

It is certified that error appears in the above-identified patent and that said Letters Patent are hereby corrected as shown below:

Column 5, line 50; after "hollow", insert ---stirrer---.

Signed and Sealed this

*Twelfth* Day of *February 1980*

[SEAL]

*Attest:*

SIDNEY A. DIAMOND

*Attesting Officer*

*Commissioner of Patents and Trademarks*